US006947703B2

(12) United States Patent
Ceresoli et al.

(10) Patent No.: US 6,947,703 B2
(45) Date of Patent: Sep. 20, 2005

(54) SYSTEM FOR DETERMINING SATELLITE RADIO LISTENER STATISTICS

(76) Inventors: Carl D. Ceresoli, 6560 Darlington Ct., Cumming, GA (US) 30040; Bruce E. Layman, 2115 Country Ridge Rd., Alpharetta, GA (US) 30004; Mike Strugatsky, 1941 Hillside Bend Crossing, Lawrenceville, GA (US) 30043; Len Eaton, 1024 Quaker Ridge Way, Duluth, GA (US) 30097

( * ) Notice: Subject to any disclaimer, the term of this patent is extended or adjusted under 35 U.S.C. 154(b) by 0 days.

(21) Appl. No.: 10/315,911

(22) Filed: Dec. 9, 2002

(65) Prior Publication Data

US 2003/0216120 A1 Nov. 20, 2003

Related U.S. Application Data

(60) Provisional application No. 60/382,070, filed on May 20, 2002.

(51) Int. Cl.[7] ..... H04H 1/00

(52) U.S. Cl. ..... 455/3.02; 455/3.05

(58) Field of Search ..... 455/3.02, 3.05, 455/3.06; 348/211.2, 208.14; 701/213–216; 705/10, 14

(56) References Cited

U.S. PATENT DOCUMENTS 5,896,554 A * 4/1999 Itoh ..... 455/2.01
6,013,007 A * 1/2000 Root et al. ..... 482/8
6,219,524 B1 4/2001 Stephens
2002/0083000 A1 * 6/2002 Kawai ..... 705/51
2002/0120501 A1 * 8/2002 Bell et al. ..... 705/14

FOREIGN PATENT DOCUMENTS

WO WO 99 13593 A 3/1999
WO WO 99 62260 A 12/1999

* cited by examiner

*Primary Examiner*—Nay Maung
*Assistant Examiner*—Tu X Nguyen

(57) ABSTRACT

The system for determining satellite radio listener statistics obtains comprehensive satellite radio listener statistics based on parameters such as satellite radio status (e.g., on/off status), satellite radio volume, satellite radio station preset information, current satellite radio station, and Global Positioning Satellite (GPS) system coordinates. The system for determining satellite radio listener statistics includes a satellite radio data device that monitors and stores all events related to the listener's interaction with the satellite radio, including automatic detection of the selected radio station through a connection to a satellite radio. The stored data is then transmitted to a central station's server for immediate storage, compilation and analysis.

21 Claims, 8 Drawing Sheets

SYSTEM FOR DETERMINING SATELLITE RADIO LISTENER STATISTICS

This application claims priority from U.S. Provisional Application Serial No. 60/382,070, filed May 20, 2002. The entirety of this provisional application is incorporated herein by reference.

FIELD OF THE INVENTION

The field of invention is satellite radio, including, a system for determining satellite radio listener statistics. More specifically, the system retrieves, determines, stores, transmits and displays satellite radio user's statistics regarding satellite radio listener's activity in selecting satellite radio station programming.

Problem

In today's competitive business environment, it is common for advertisers, marketers, business concerns and the like to desire to gauge the likes and dislikes of the general public. It is important to successful business endeavors to have some measure of the public's reaction to a business concern's products and services. This fundamental principle of business is no less true in the satellite radio industry. That is, in the satellite radio world, monitoring listener's selections and determining the demographics of listeners is essential to running a successful satellite radio business. Satellite radio business executives exert significant amount of energy searching for more detailed information to guide their marketing investment.

Arbitron, Inc. of New York, N.Y. currently offers a radio listener statistical gathering and reporting service (i.e., a rating service). Arbitron rates broadcasts based on the listening audience tuned into a particular station on a quarterly basis, but currently offers no such service for satellite radio. Also, many of today's rating services survey listeners and then summarize and compile the surveys to provide data to those interested in their results. The problem with paper questionnaires is that they are not real-time data.

More specifically, the Arbitron process collects these paper questionnaires via random sampling of a market. Thus, for a given market, a certain percentage of the population is randomly selected and called. The calls to these selected individuals are generated by random number dialing. Those persons who are contacted via the telephone are then asked if they are willing to participate in the Arbitron diary process. The diary consists of three types of questions: (1) What did you listen to? (2) When did you listen to it? (3) Where were you when you listened to it? The participants are asked to collect this information and write it down in the provided diary over a seven-day period. At the end of that seven-day period, the diary is sent back to Arbitron. This process is repeated until a statistically relevant number of diaries are collected in the given market. This process is dependent on user participation, so if a group of listeners did not want to take the time to participate in the questionnaires, then the service would be less effective.

Further, apparatus to monitor the selected broadcast radio station within a vehicle are known. These apparatuses employ one of two known methods for detecting the tuned radio station. One method, known as a "sniffer" method, involves tuning the receiver to the local radio phase lock loop (PLL) and then calculating the tuned frequency by knowing the intermediate frequency (IF). The second method, known as a "comparator" method, involves comparing output audio signals from the speaker port to a (known) reference audio signal (i.e., a pre-selected radio station). Then, if the two signals are in phase, the tuned radio station can be identified. Both of these on-board methods are not compatible with digital data transmissions from the receiver of a satellite radio unit to the tuner of the unit.

A system that comprehensively monitors satellite radio data to determine the demographics of listeners on a real-time, or near real-time, basis has not previously existed. Nor has an apparatus that automatically detects the listener selection choices in a satellite radio receiver. Therefore, given the above, what is needed is a real-time system for obtaining, monitoring, recording and reporting comprehensive satellite radio listener statistics which include an apparatus that automatically detects the selected radio station on a satellite radio receiver.

Solution

The present satellite radio listener statistics system meets the above-identified needs by providing a system for determining satellite radio listener statistics solves the above-noted problems by obtaining, monitoring, recording and reporting comprehensive satellite radio listener statistics in real-time or near real-time.

The present satellite radio listener statistics system collects satellite radio listener statistics from a vehicle or portable radio via a non-obtrusive apparatus. This apparatus monitors and stores all events and parameters related to a user's interactions with a satellite radio receiver or broadcast. Parameters monitored include, for example, radio status (e.g., on/off status), satellite radio station selected and geographical location of the satellite radio. Each time a monitored parameter changes (e.g., a station is changed), the event is dated, time stamped and stored in the satellite radio listener statistics system. The stored data is then transmitted periodically, via existing wireless networks and paging systems, to a central station (i.e., central station server) for immediate compilation and analysis. Results are then made available to users, including, for example, satellite radio services, corporate advertisers, and advertising agencies.

The satellite radio listener statistics system also includes an apparatus in close proximity of the satellite radio that automatically detects the presently selected satellite radio station and a satellite radio station as it is being selected. The apparatus uses a satellite radio data device to detect transmission of digital data over a data line between the tuner and satellite radio receiver of a satellite radio.

An advantage of the present satellite radio listener statistics system is that it allows continuous parameter sampling of a plurality of satellite radio units in order to provide more statistically accurate results. A satellite radio that is connected to a satellite radio data device is monitored continuously to provide the central station with real-time accurate statistics. The real-time statistics are instantly provided, via the Internet or other communications system, to users of the satellite radio listener statistics system, which include satellite radio providers, corporate advertisers, advertising agencies and the like.

Another advantage of the present satellite radio listener statistics system is that it implements an unbiased and error-free data collection method that is not dependent on participant participation. The present satellite radio listener statistics system provides error-free data collection by monitoring the modulated data stream between the tuner and satellite radio receiver to detect satellite radio channel changes initiated by the listener, instead of relying on surveys that take time to complete and are prone to errors through incorrect memory recall. The present satellite radio listener statistics system provides real-time data retrieval from a satellite radio and transmittal of the data to the central station, for storage, analysis and display according to a user's wishes.

Further features and advantages of the satellite radio listener statistics system as well as the structure and operation of various embodiments of the present satellite radio listener statistics system are described in detail below with reference to the accompanying drawings.

DESCRIPTION OF THE DRAWINGS

The features and advantages of the present satellite radio listener statistics system will become more apparent from the detailed description set forth below when taken in conjunction with the following drawings.

DETAILED DESCRIPTION

Figure 1:
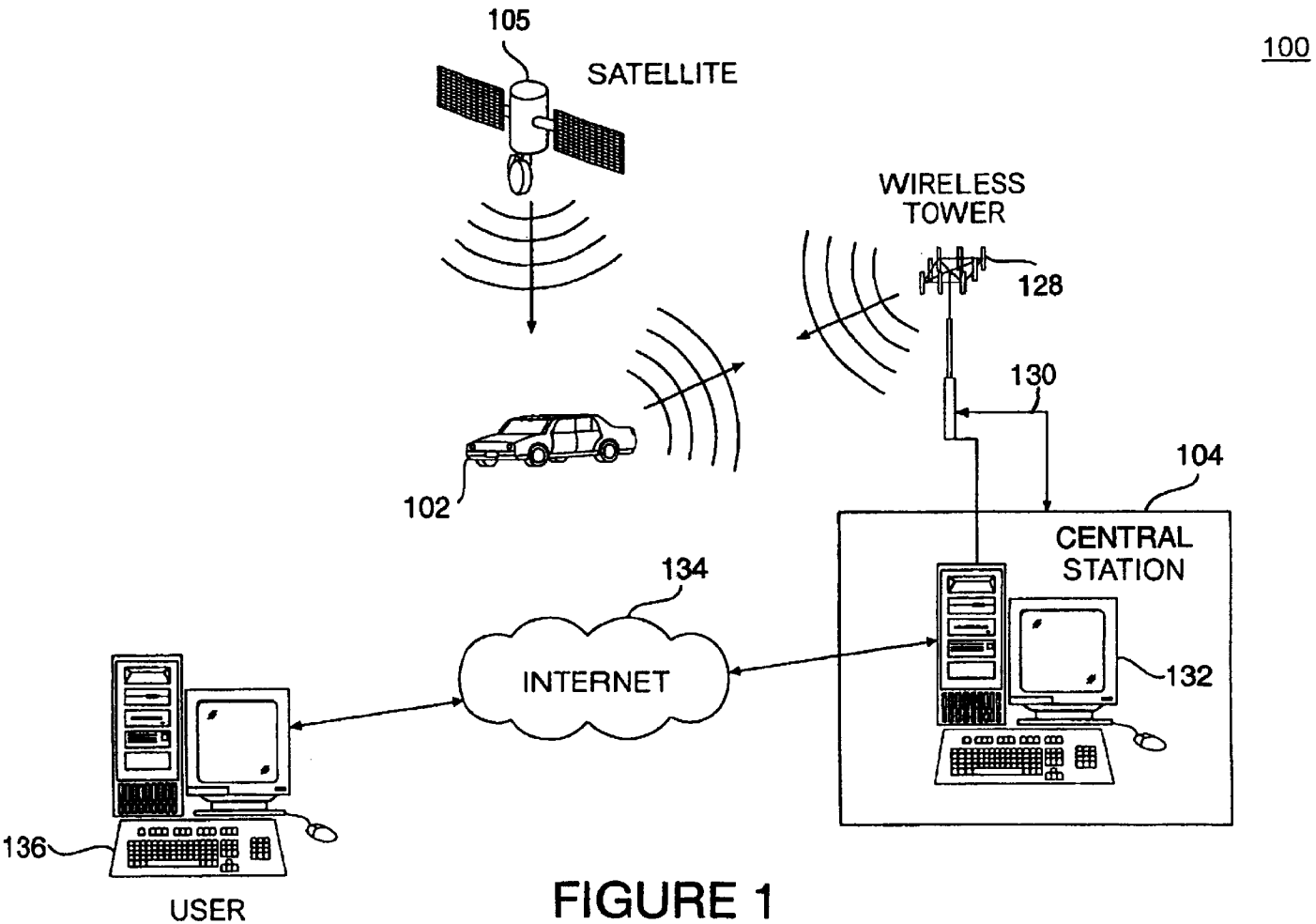
FIG. 1 illustrates the satellite radio listener statistics system.

Layout of the Radio Listener Statistics System

I. Overview

In an embodiment of the present satellite radio listener statistics system, a service provider organization provides and allows access, perhaps on a subscriber fee or pay-per-use basis, to a tool that obtains, monitors, records and reports comprehensive satellite radio listener statistics via the global Internet. That is, the service provider would provide the hardware (e.g., servers) and software (e.g., database) infrastructure, application software, customer support, and billing mechanism to allow its customers (e.g., satellite radio providers, corporate advertisers, advertising agencies and the like) to receive reports of, for example, listener reaction to specific events or segments. This tool would be used by subscribers to obtain both real-time and historical information, characteristics, and trend analysis to make marketing and advertising decisions.

The level of detail collected by the present satellite radio listener statistics system, which has not been seen in any other conventional systems, allows satellite transmission companies and advertisers the ability to accurately measure the effectiveness of new marketing campaigns, radio personalities, or other satellite transmissions. Advertisers can know, within days, for example, how many listeners heard their advertisements, how many turned the station seconds into the advertisements, and how many turned the volume up to hear a particular satellite transmission segment. Stations are able to determine listener reactions to new satellite radio talents and satellite segments identifying events that cause listeners to migrate to competitors. In each case, the reported statistics provide the ability to adjust and refine satellite radio content contributing to its overall effectiveness and value by reducing listener churn.

In an embodiment of the present satellite radio listener statistics system the service provider provides a World Wide Web site where a subscriber, using a computer and Web browser software, can remotely view and receive comprehensive satellite radio listeners statistics.

In an alternative embodiment, the tool that obtains, monitors, records and reports comprehensive satellite radio listener statistics may reside, instead of on the global Internet, locally on proprietary equipment owned by a subscriber (i.e., satellite radio providers, corporate advertisers, advertising agencies and the like) as a stand alone system software application.

The terms "user," "subscriber," "customer," "company," "business concern," "satellite radio provider," "corporate advertiser," "advertising agency," and the plural forms of these terms are used interchangeable throughout herein to refer to those who would access, use, and/or benefit from the tool that the present invention provides for obtaining, monitoring, recording and reporting comprehensive satellite radio listener statistics.

II. System Architecture

A present-day satellite radio consists of an antenna, a tuner, and a satellite radio receiver. When a user selects a station, the satellite radio receiver typically sends a command to the tuner to select the station. Then, when the tuning process has been completed, the satellite radio receiver typically acknowledges the new station to the user on the satellite radio receiver's display. These transmissions, between the tuner and the satellite radio receiver, typically occur on a digital communications bus.

Figure 2:
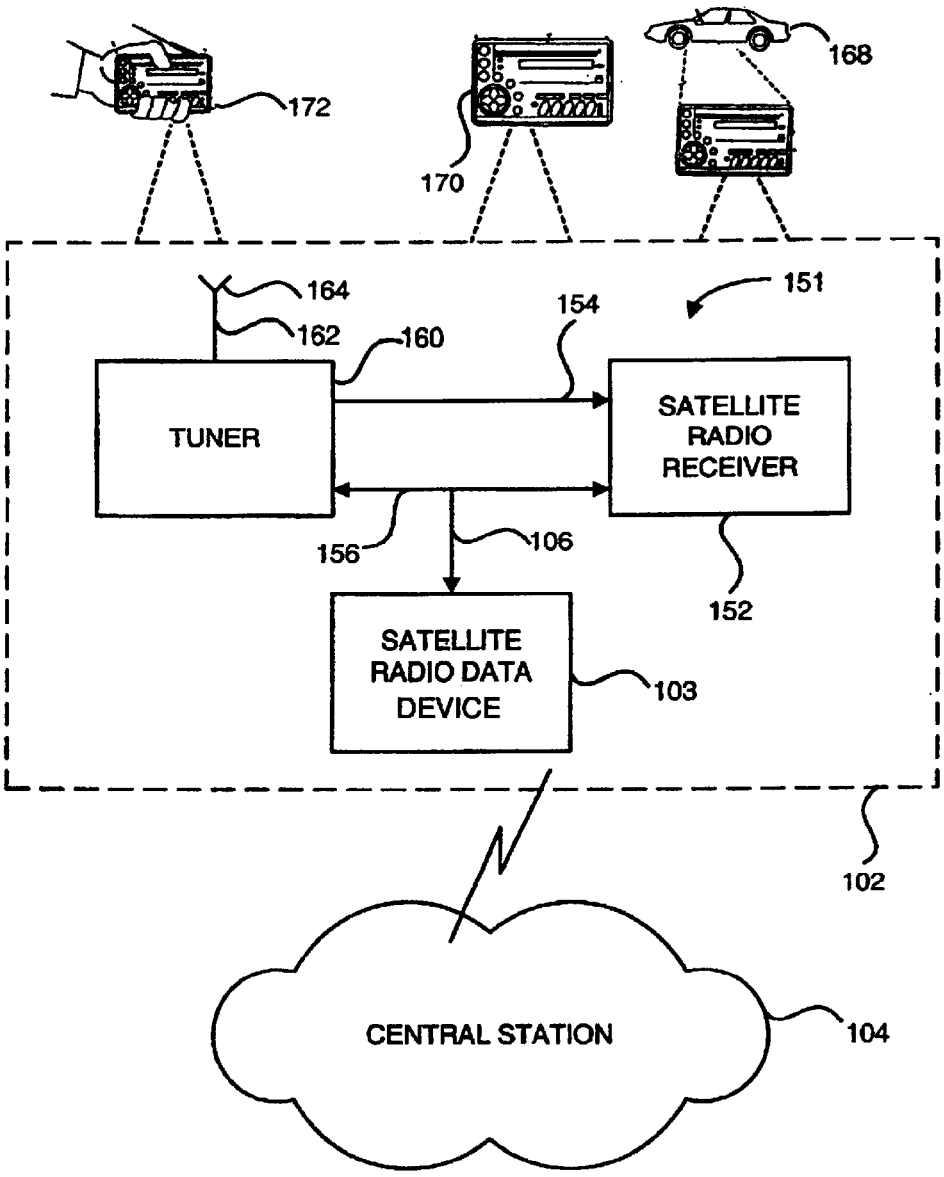
FIG. 2 illustrates the satellite radio data apparatus in connection with a central station.

Referring to FIG. 1, a block diagram illustrating the satellite radio listener statistics system 100 showing network connectivity between the various components, is shown. The radio listener statistics system 100 includes a satellite radio data apparatus located in and an integral part of a motor vehicle 102 for example, and a central station 104. The satellite radio apparatus is pictured as part of the equipment in the car 102, but it can be embodied in any satellite radio receiver such as portable satellite radio receiver 172, large satellite radio receiver 170 as well as the satellite radio receiver in automobile 168 and 102, as shown in FIG. 2.

The central station 104 serves as market specific data gatekeepers. That is, users 136 are able to pull information from specific, multiple or all markets at any given time for immediate analysis. The distributed computing model has no single point of complete system failure, thus minimizing satellite radio listener statistics system 100 downtime. In an embodiment, central station 104 contains a transmitter/receiver 123 in order to connect to the existing communications network (e.g., wireless towers 128). In another embodiment, the central station 104 connects to the existing communications network via a paging and email system, as is commonly known to those skilled in the relevant art(s).

The satellite radio listener statistics system 100 includes a plurality of users 136 (satellite radio providers, corporate advertisers, advertising agencies, and the like) which would access satellite radio listener statistics system 100 using a personal computer (PC) or other such computing device, running a commercially available Web browser. (For simplicity, FIG. 1 shows only one user 136.) The users 136 would connect to the parts (i.e., infrastructure) of the satellite radio listener statistics system 100 which are provided by the provider via the global Internet 134, or alternatively other communication systems, such as wireless email and phones. In alternative embodiments, users 136 may access the satellite radio listener statistics system 100 using any processing device including, but not limited to, a desktop computer, laptop, palmtop, workstation, set-top box, personal digital assistant (PDA), and the like.

The satellite radio listener statistics system 100 also includes a central station 104 which contains a central station server 132. Central station server 132 is the "backbone" (i.e., system processing) of the present satellite radio listener statistics system 100. It provides the "front-end of the satellite radio listener statistics system 100. That is, central station server 132 contains a Web server process running at a Web site which sends out Web pages in response to requests from remote browsers (i.e., users 136 of the satellite radio providers). More specifically, it provides a graphical user interface (GUI) "front-end" screens to users 136 of the satellite radio listener statistics system 100 in the form of Web pages. These Web pages, when sent to the subscriber's PC (or the like), would result in GUI screens being displayed.

In an embodiment of the present satellite radio listener statistics system 100, the central station 104 includes a paging network that communicates wirelessly to the radio data apparatus 102. The central station 104 further includes a central station server 132 that communicates with the paging network via email or other known communications process known to those skilled in the art. The central station 104 compiles the satellite radio listener data retrieved from the satellite radio data apparatus 102. This compiled data is then accessed by customers 136 through the Internet 134 or other forms of communication, including cell phones, telephones and facsimile. The satellite radio listener data includes the present satellite radio station setting, station preset information, time stamp and date stamp of satellite radio station selection, global positioning system coordinates, and satellite radio status.

In an embodiment of the present satellite radio listener statistics system 100, satellite radio data apparatus 102 includes a transceiver that takes advantage of existing wireless communication networks to transfer information collected by the satellite radio data device 103 and stored in its memory 112 to central station 104. Thus, such a transceiver would be compatible with wireless mobile communications.

All of the components inside of central station 104 are connected and communicate via a wide or local area network (WAN or LAN) with a hub 318 running a secure communications protocol (e.g., secure sockets layer (SSL)) and having a connection to the Internet 134.

Figure 1A:
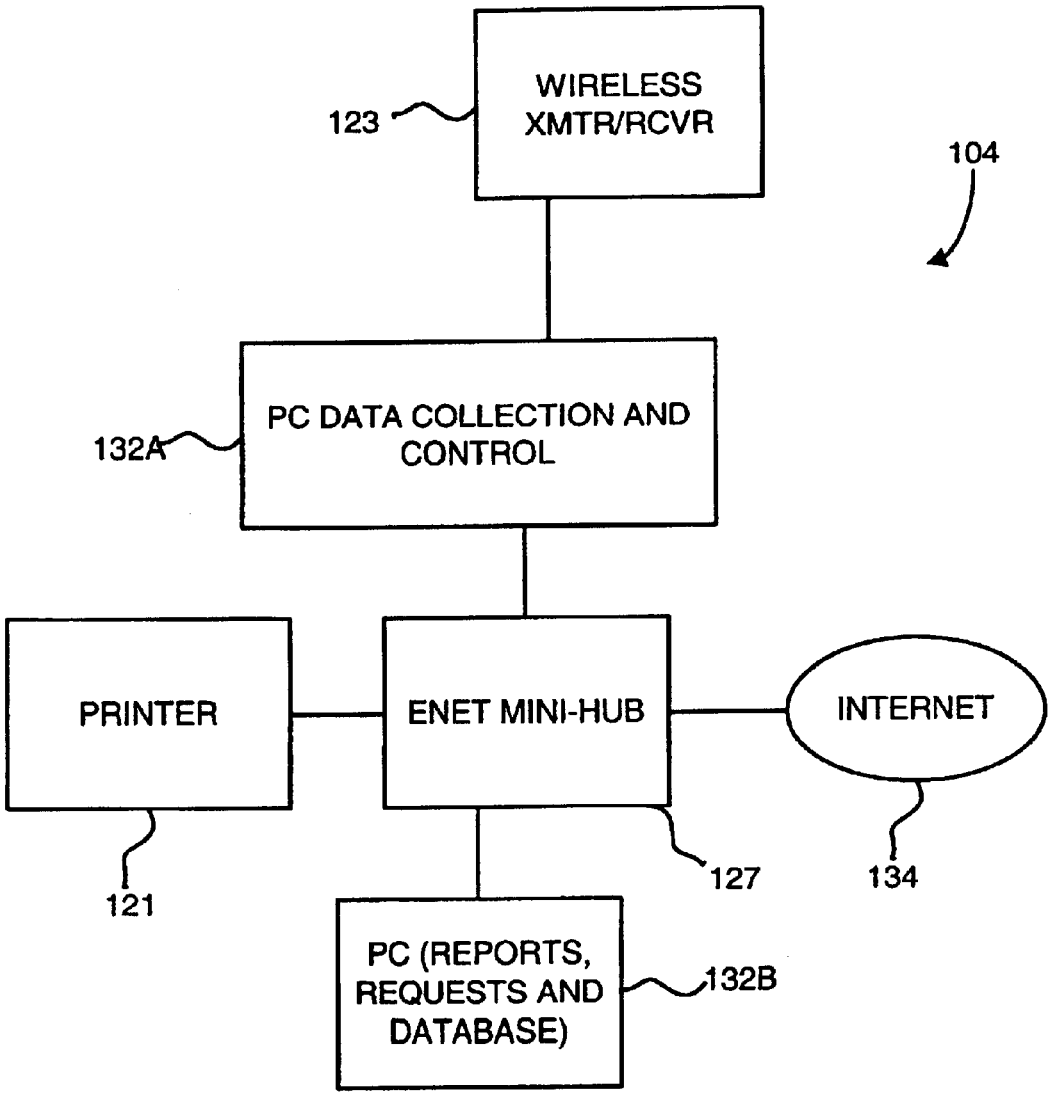
FIG. 1A illustrates the central station of the satellite listener statistics system.

FIG. 1A, is a block diagram of the central station 104. In an embodiment, central station 104 is distributed according to specific tasks. While two separate central station servers 132 (i.e., 132A for data collection and server 132B for report generation) are shown in FIG. 1A for ease of explanation, it will be apparent to one skilled in the relevant art(s) that satellite radio listener statistics system 100 may utilize servers (and databases) physically located on one or more computers. Each central station server 132 contains software code logic that is responsible for handling tasks such as data interpretations, statistics processing, data preparation and compression for output to satellite radio data apparatus 102, and report generation for output to users 136 or printer 121, respectively. In an embodiment, central station 104 contains a transmitter/receiver 123 in order to connect to the existing communications network (e.g., wireless towers 128). In another embodiment, the central station 104 connects to the existing communications network via a paging and email system, as is commonly known to those skilled in the relevant art(s).

In an embodiment of the present satellite radio listener statistics system 100, central station server 132 has access to a repository database which is the central store for all information and satellite radio listener data within the satellite radio listener statistics system 100 (e.g., executable code, subscriber information such as login names, passwords, etc., and vehicle and demographics related data).

Satellite radio listener statistics system 100 also includes a plurality of satellite radio data apparatus 102 each with a satellite radio data device 103 which is explained in more detail below. (For simplicity, FIG. 1 shows only one satellite radio data apparatus 102). In an embodiment of the present satellite radio listener statistics system 100, the satellite radio data device 103 has access to the satellite radio 151, as explained in more detail below, in order to monitor, record, store and transmit the listener parameters as explained herein.

Satellite radio listener statistics system 100 includes at least one satellite 105 from which a satellite radio provider transmits their signal. These signals are received by satellite radios 151 and thus, may be monitored by the satellite radio data device 103 as described herein.

Satellite radio listener statistics system 100 also includes a wireless communication infrastructure which, in one embodiment, consists of one or more wireless towers 128. (For simplicity, FIG. 1 shows only one tower 128). The satellite radio data device 103 is configured for the specific means of wireless mobile communications employed within the market area in which the satellite radio listener statistics system 100 operates (e.g., satellite or terrestrial wireless). This allows the satellite service provider to take advantage of existing wireless communication networks to transfer information collected by the satellite radio data device 103 to central station 104.

Referring to FIG. 2, a block diagram of the physical architecture of a satellite radio data apparatus 102 including a satellite radio 151 and its connection to a satellite radio data device 103 is shown. The satellite radio data apparatus 102 includes satellite radio 151.

FIG. 2 is an illustration of the satellite radio data apparatus 102 connected to a satellite radio 151. The satellite radio 151 is known in the art and comprises a antenna 164 for receiving data signals from an auxiliary source, such as a satellite or an earth based repeater station (not shown). The satellite radio 151 also includes a tuner 160 that receives the data signals from the satellite radio antenna 164 via satellite radio antenna connection 162. It is known in the art that the satellite radio signal can be frequency modulated at the tuner 160 and sent to a satellite radio receiver 152 via content connection 154. Modulation is the method of varying or changing some characteristic of an electrical carrier wave as the information to be transmitted on that carrier wave varies.

A user makes radio channel selections at the satellite radio receiver 152. A selection by the user at the satellite radio receiver 152 creates a data stream back to the tuner 160 via modulated connection 156. This data stream contains information regarding the selection at the satellite radio receiver 152 by the user. Among other information, the data stream comprises time, date and radio channel information regarding the user's selection. Other information contained in this data stream comprises geographic location of the satellite radio 151, artist information and title of the audio data. This data stream is typically modulated and can be on a separate line than the audio content of the satellite radio 151.

The satellite radio data device 103 includes a transceiver driver that transmits and receives data, provides data packets and collision detection as well. The satellite radio data device 103 further includes a delay generator that provides additional time introduced by network in delivering a packet's worth of data. Further, the satellite radio data device 103 may include a packet detector for packet filtering.

The satellite radio data device 103 samples this data stream via data connection 106 for signals that a data stream is being sent from the satellite radio receiver 152 to the tuner 160. This data stream is generated when a user selects a different radio channel at the satellite radio receiver 152, which then sends the data stream to the tuner 160. The satellite radio data device 103 can be located in small to large electronic satellite radio devices such as portable satellite radio 172 and large satellite radio 170. The satellite radio data apparatus 102 can alternatively be located in an automobile 168 or any electronic devices that utilize satellite radio signals.

Figure 3:
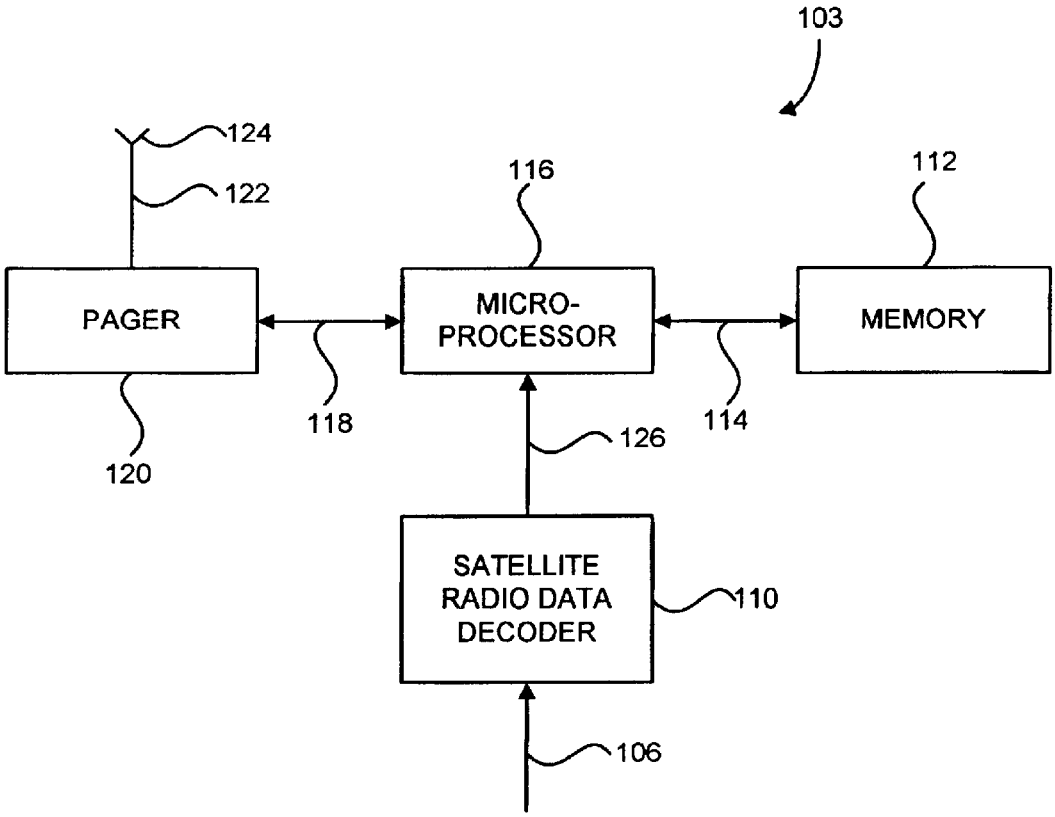
FIG. 3 illustrates an embodiment of the satellite radio data device.

FIG. 3 is a block diagram of the physical architecture of a satellite radio data device 103. The satellite radio data device 103 includes a microprocessor 116 which is connected to a satellite radio data decoder 110 via microprocessor connection 126. The satellite radio data device 103 further includes a 112 connected to microprocessor 116 via memory connection 114. The memory 112 stores instructions for the microprocessor 116. These instructions include instructions for synchronizing with a modulated data stream, instructions for converting binary data into hexadecimal data, searching for the most significant bit or byte and searching for the least significant bit or byte. The most significant bit or byte is that portion of a number address or field which occurs left most when its value is written as a single number in conventional hexadecimal or binary notation. The least significant bit or byte is that portion of a number address or field which occurs right most when its value is written as a single number in conventional hexadecimal or binary notation.

Satellite radio data device 103 may also include an internal clock for date and time stamps and software code logic to drive the functionality described herein (i.e., interpretation of data sent from the satellite radio receiver 152, and information sent from the central station 104, and data preparation and compression, conversion or output data for transmission to the central station 104). In one embodiment, such internal clock would be part of the microprocessor 116 which is explained in more detail below.

The satellite radio data device 103 further includes a pager 120 connected to microprocessor 116 via pager connection 118. The satellite radio data device 103 further includes a satellite radio data device antenna 124 connected to pager 120 via antenna connection 122. The locations of any or all of these devices may be in close proximity of each other. In another aspect, some of these devices may be located distant from each other. The location of the satellite radio data device 103 is in close proximity of the satellite radio 151.

Figure 4:
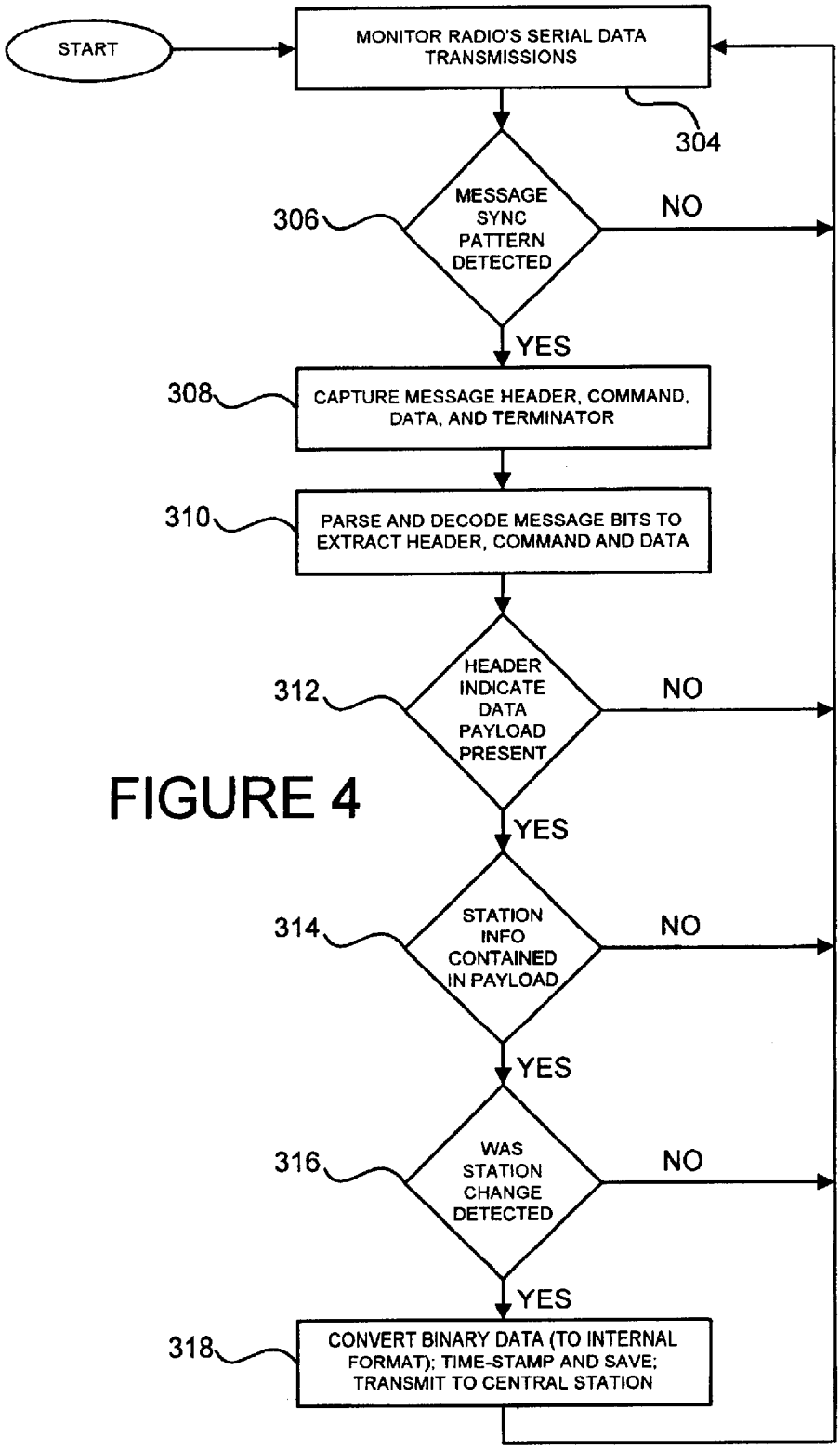
FIG. 4 illustrates in flow diagram form the satellite radio data apparatus retrieving and determining the data stream from a satellite radio.

FIG. 4 is a block flow diagram of the satellite radio data apparatus 102 retrieving and determining the data stream from a satellite radio 151. In step 304 the satellite radio data device 103 monitors the satellite radio 151 serial data transmissions. In step 306 the radio data device 103 rapidly monitors the data stream traffic on the modulated connection 156 for packets of data. The satellite radio data device 103 queries whether a message synchronization pattern was detected. If the answer to this query is no, the satellite radio data device 103 continues to monitor the modulated connection 156. If the answer to the query is yes, then in step 308 the satellite radio data device 103 captures the message header, command, data and the terminator of the data packet. In this step, the satellite radio data apparatus 102 sees the packet and grabs the next bits until the data stream is idle. In step 310, the satellite radio data device 103 analyzes the message retrieved from modulated connection 156 to extract specific command actions and data.

The target pulse width for the signals in the satellite radio 151 are 26–28 microseconds for one clock and 50–60 microseconds for the other clock in a flip flop arrangement. The signal at the modulated connection 156 is pulse width modulated (0 to 1 transition at the start of each bit and the bit width is 38 microseconds). The satellite radio data device 103 clocks off of the modulated data stream. Initially, the modulated connection 156 and the data connection 106 can have different signals based on timing. Such as the modulated connection 156 having a signal of "0" when it's idle and a signal of "1" when it's active. The satellite radio data device 103 synchronizes these two lines.

The bit rate is about 26 kilobits per second. In step 310, the satellite radio data device 103 parses and decodes the message bits to extract the header, command and data contained in the data stream retrieved from the modulated connection 156. The data is sent in packets (frames) which are identified by the frame start pulse (width 170 microseconds) and the types of frames include 64, 128 or 256 bits each. The satellite radio data device 103 decodes a bit sequence from a specified ASCII input file, which was captured via a logic state analyzer. Options include searching for a specific bit pattern, inverting bits, etc. The satellite radio data device 103 analyzes the data stream of a satellite tuner radio and searches for a message header, and displays the entire packet contents, in binary and hex, until an inter-packet sequence (typically a string of null characters) are encountered.

In step 312, the satellite radio data device 103 queries whether a message header of the modulated data stream indicates if a data payload is present. If the answer to this query is no, then the satellite radio data device 103 continues to monitor the serial data transmissions. If the answer to this query is yes, then the satellite radio data device 103 proceeds to step 314. In step 314, the satellite radio data device 103 queries whether the station information is contained in the payload. If the answer to this query is no, then the satellite radio data device 103 continues to monitor the serial data transmissions. If the answer to this query is yes, then the radio data device 103 proceeds to step 316. In step 316, the satellite radio data device 103 queries whether a station change was detected. A station change is detected when the data packets (frames) of increasing frequency and content are detected on the modulated data stream. If the answer to this query is no, then the satellite radio data device 103 continues to monitor the serial data transmissions. If the answer to this query is yes, the satellite radio data device 103 proceeds to step 318. In step 318, the satellite radio data device 103 converts the binary data to an internal format, such as hexadecimal, then it time stamps the data and saves the data to memory 112 for later transmission via wireless communications to the central station 104. The data stored to memory 112 is paged via a paging network, where the data is then forwarded by email to the central station 104. The satellite radio data device 103 then continues to monitor the modulated connection 156 for additional serial data transmissions.

The overall flow and operation of the satellite radio listener statistics system 100 is typically as follows: After a pre-determined time interval (e.g., a time interval measured in days, hours, minutes, etc.) of monitoring the satellite radio 151, the satellite radio data apparatus 102 prepares all stored data for transmission. The packet of information is sent via a wireless link 128 to central station 104 through central station transceiver 123. There, the data is processed (i.e., compiled and analyzed) by server 132A. The information is then made ready for distribution (i.e., reports are generated by server 132B) to users 136. The satellite radio data apparatus 102 may be configured to transmit data collected from the vehicle with varying frequency (e.g., once every 5 minutes, twice a day, etc.). Such frequency would depend on factors such as the size of the memory 112 of the satellite radio data device 103, bandwidth of the existing communications network, needs of the users 136 and the like.

EXAMPLE 1

Sample Data Stream #1

Figure 5:
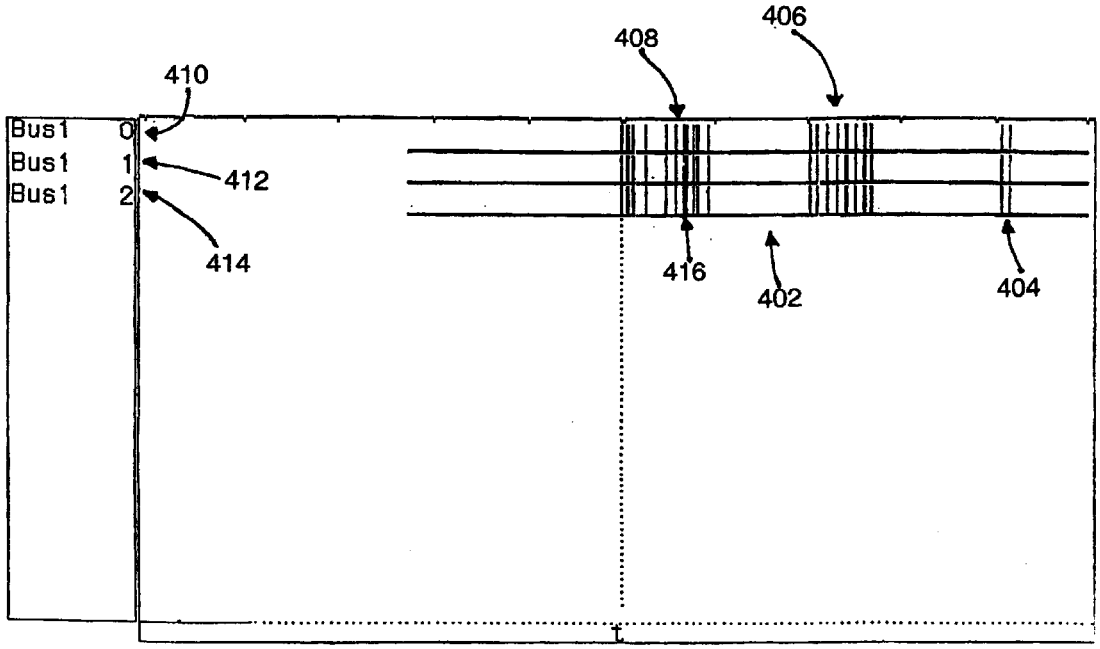
FIG. 5 illustrates sample data frames retrieved from a modulated data stream.

FIG. 5 illustrates a sample data stream retrieved from a modulated data stream of a transceiver chip in a satellite radio 151 by the satellite radio data device 103. The satellite radio data device 103 includes a 157 Timer and a Dual Flip-Flop. Row 410 is the data stream from the satellite radio receiver 152. Row 412 is the data stream from the tuner 160 and row 414 is the data stream from the satellite radio data device 103. The few lines of data stream shown in 404 reflect idle or little user selection. The signal from the satellite radio receiver 151 that a start of a packet is being transmitted is when a predetermined data field is transmitted between the tuner 160 and the satellite radio receiver 152. The data stream frames 406 and 408 show increased user selection activity on the modulated data stream. Each data packet line 416 represents a data packet that contains 8–32 bytes of information. Data packet line 416 is representative of one data packet line. Data packets can vary in size and spacing and data packet line 416 is shown to represent one and is not indicative of all data packet lines. Idle area 402 shows no data stream activity. These idle areas can be represented by null streams or characters. Null characters are transmitted to fill space, time or "pad" something. These null characters add nothing to the meaning of the message but are expected by the satellite radio 151.

EXAMPLE 2

Sample Data Stream #2

Figure 6:
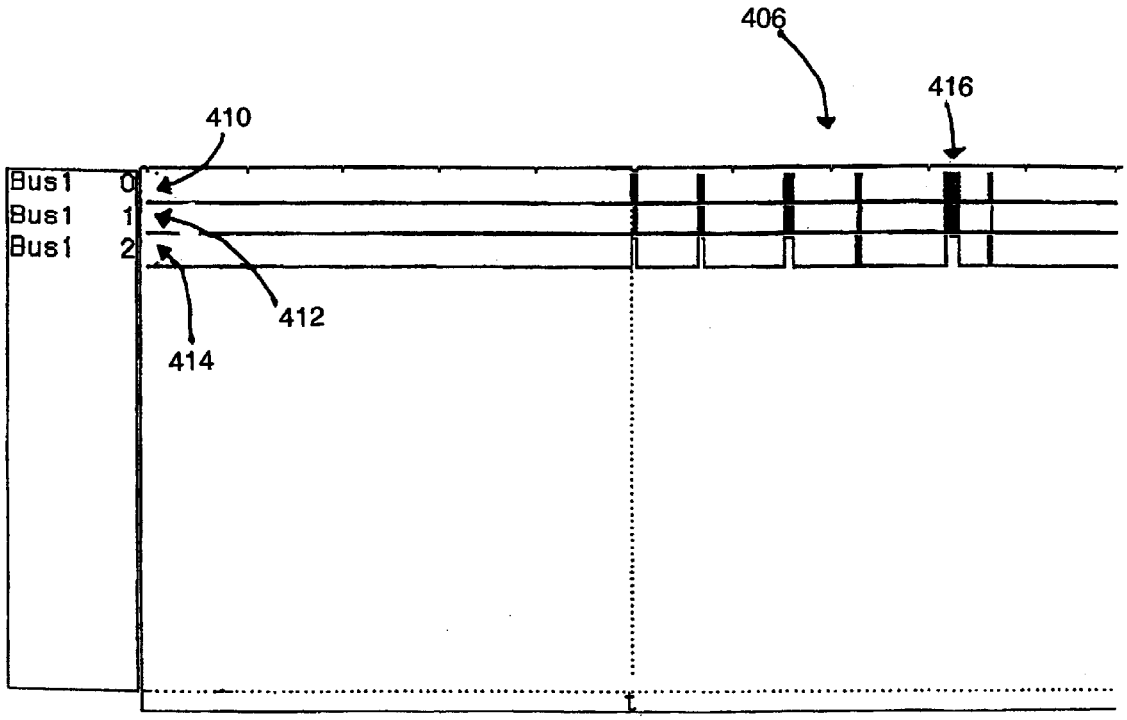
FIG. 6 illustrates, with higher resolution, sample data packets retrieved from a modulated data stream.
Figure 7:
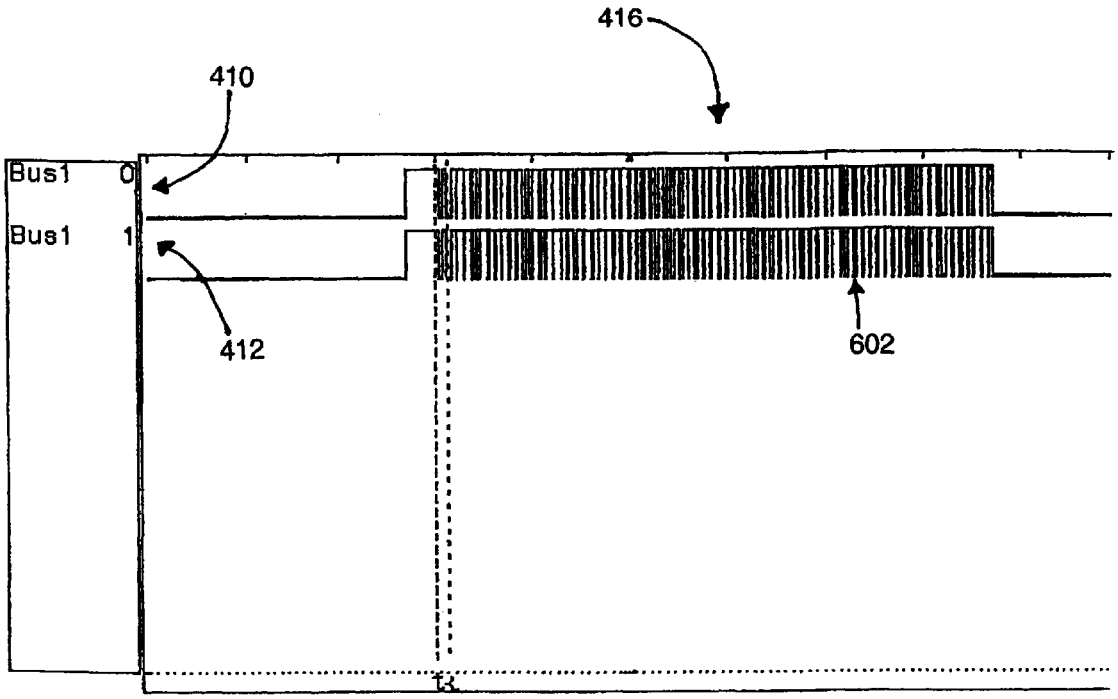
FIG. 7 illustrates, with higher resolution still, sample data bits retrieved from a modulated data stream.

FIG. 6 illustrates a sample data stream retrieved from a modulated data stream of a transceiver chip in a satellite radio 151 by the satellite radio data device 103. The same satellite radio data device 103 and satellite radio 151 components of Example 1 are used. This illustration depicts a higher resolution of the data stream frame 408. The varied widths of the data stream packets, such as data packet line 416 are shown.

EXAMPLE 3

Sample Data Stream #3

FIG. 6 illustrates a sample data stream retrieved from a modulated data stream of a transceiver chip in a satellite radio 151 by the satellite radio data device 103. The same satellite radio data device 103 and satellite radio 151 components of Example 1 are used. This illustration depicts a higher resolution of data stream packet lines. The illustration depicts individual bits 602 of a data packet line 416.

While various embodiments of the present invention have been disclosed above, it should be understood that they have been presented by way of example, and not limitation. It will be apparent to persons skilled in the relevant art(s) that various changes in form and detail can be made therein without departing from the spirit and scope of the invention. For example, the satellite radio data apparatus may be located within a satellite radio, instead of located outside the body of a satellite radio. In fact, after reading this description herein, it will become apparent to a person skilled in the relevant art(s) how to implement the apparatus and method of the present invention using other decoding devices than those described above, to monitor and detect data packets sent from the satellite radio receiver to the tuner. Thus, the present invention should not be limited by any of the above-described exemplary embodiments, but should be defined only in accordance with the following claims and their equivalents.

What is claimed:

1. A system for allowing a user to obtain comprehensive satellite radio listener statistics, from a plurality of satellite radios each having a tuner, a receiver and a data connection between said tuner and said receiver, comprising:

means, connected to said data connection, for detecting a satellite radio data packet on said data connection between said tuner and said receiver;

means for using said satellite radio data packet to create satellite radio listener data which represents one or more interactions by a user with said receiver;

means, connected to each of said plurality of satellite radios, for receiving said satellite radio listener data from said satellite radios;

means for transmitting said satellite radio listener data;

central station means capable of receiving said satellite radio listener data from each of said means for transmitting, and producing statistics based on received said satellite radio listener data; and interface means, provided by said central station means, for delivering reports to said user containing statistics based on said received said satellite radio listener data.

2. The system of claim 1, wherein said satellite radio listener data includes global positioning system coordinates and at least one of the following: satellite radio status; station preset information; and current satellite radio station setting.

3. The system of claim 1, wherein said interface means further comprises: an Internet connection means.

4. The system of claim 1, wherein said means for detecting further comprises: a means for monitoring said data connection of said satellite radios.

5. The system of claim 4, wherein said means for detecting further comprises: a means for synchronizing signals of said data connection with said monitoring means.

6. The system of claim 1, wherein said satellite radio data packet includes a message a header, a command, a data and a terminator.

7. The system of claim 1, wherein said means for detecting further comprises: a means for storing said satellite radio data packet.

8. The system of claim 1, wherein said means for using further comprises: a means for parsing said satellite radio data packet.

9. The system of claim 8, wherein said means for using further comprises: a means for converting data parsed from said satellite radio data packet to another format.

10. The system of claim 8, wherein said means for parsing further comprises: a means for time and date stamping data parsed from said satellite radio data packet.

11. A method for generating comprehensive satellite radio listener statistics, comprising:

detecting a satellite radio data packet on a data connection between a tuner and a receiver of a satellite radio device;

using said satellite radio data packet to create satellite radio listener data which represents one or more interactions by a user with said receiver;

receiving said satellite radio listener data from said satellite radio data device at a central station;

producing at said central station statistics based on said received satellite radio listener data; and generating, a report containing said statistics based on said satellite radio listener data.

12. The method of claim 11, wherein said satellite radio listener data is selected from the group consisting of radio status, station preset information, and current satellite radio station setting.

13. The method of claim 11, wherein said receiving satellite radio listener data further comprises:

global positioning and time stamping data.

14. The method of claim 11, further comprising: synchronizing signals of said satellite radio data packet when detecting said satellite radio data packet on said data connection between said tuner and said receiver.

15. The method of claim 11, wherein said receiving satellite radio listener data further comprises: retrieving said satellite radio data packet.

16. The method of claim 11, wherein said using said satellite radio data packet further comprises: storing said satellite radio data packet.

17. The method of claim 11, wherein said using said satellite radio data packet further comprises: parsing data from said satellite radio data packet.

18. The method of claim 17, wherein said using said satellite radio data packet further comprises: converting said data parsed from said satellite radio data packet to another format.

19. The method of claim 17, wherein said using said satellite radio data packet further comprises: time and date stamping said data parsed from said satellite radio data packet.

20. The method of claim 14, wherein said generating said report further comprises: making said report available over at least a portion of the global internet.

21. The method of claim 11, wherein said using said satellite radio data packet is performed periodically on a pre-determined time interval.

* * * * *